US008240826B2

(12) United States Patent
Fukushima et al.

(10) Patent No.: US 8,240,826 B2
(45) Date of Patent: Aug. 14, 2012

(54) INK TANK FOR LIQUID PRINTING APPARATUS, METHOD OF MANUFACTURING SAME, LIQUID PRINTING APPARATUS WITH SAME, AND METHOD OF DETECTING REMAINING INK

(75) Inventors: Takashi Fukushima, Kawasaki (JP); Toshihiko Ujita, Yokohama (JP); Shinichi Miyauchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 360 days.

(21) Appl. No.: 12/709,143

(22) Filed: Feb. 19, 2010

(65) Prior Publication Data

US 2010/0141719 A1 Jun. 10, 2010

Related U.S. Application Data

(62) Division of application No. 11/667,754, filed as application No. PCT/JP2005/023092 on Dec. 9, 2005, now Pat. No. 7,726,792.

(30) Foreign Application Priority Data

Dec. 9, 2004 (JP) ..... 2004-357302

(51) Int. Cl.
*B41J 2/175* (2006.01)

(52) U.S. Cl. ..... 347/86

(58) Field of Classification Search ..... 347/7, 19, 347/85, 86, 95; 73/290 R, 293; 116/227; 137/386; 250/227.11
See application file for complete search history.

(56) References Cited

U.S. PATENT DOCUMENTS

| | | | | |
|---|---|---|---|---|
| 4,540,595 | A | 9/1985 | Acitelli et al. | 427/7 |
| 5,093,147 | A | 3/1992 | Andrus et al. | 427/7 |
| 5,614,008 | A | 3/1997 | Escano et al. | 106/23 D |
| 5,616,929 | A | 4/1997 | Hara | 250/573 |
| 5,932,139 | A | 8/1999 | Oshima et al. | 252/301.16 |
| 5,990,197 | A | 11/1999 | Escano et al. | 523/160 |
| 5,997,121 | A * | 12/1999 | Altfather et al. | 347/7 |
| 6,149,719 | A | 11/2000 | Houle | 106/31.14 |
| 6,293,143 | B1 | 9/2001 | Denton et al. | 73/293 |
| 6,361,136 | B1 | 3/2002 | Watanabe et al. | 347/7 |
| 6,513,921 | B1 | 2/2003 | Houle | 347/96 |
| 6,616,255 | B2 | 9/2003 | Murakami et al. | 347/7 |
| 7,234,787 | B2 * | 6/2007 | Grady et al. | 347/7 |
| 2007/0159505 | A1 | 7/2007 | Yamamoto | 347/7 |

FOREIGN PATENT DOCUMENTS

| | | |
|---|---|---|
| JP | 60-029996 | 2/1985 |
| JP | 7-304189 | 11/1995 |
| JP | 8-003548 | 1/1996 |
| JP | 2000-043287 | 2/2000 |
| JP | 2004-314479 | 11/2004 |

* cited by examiner

*Primary Examiner* — Anh T. N. Vo
(74) *Attorney, Agent, or Firm* — Fitzpatrick, Cella, Harper & Scinto

(57) ABSTRACT

An ink tank capable of optically detecting ink remaining in an ink accommodation chamber with high precision is provided. A printing apparatus, a method of manufacturing the ink tank, and a method of detecting ink remaining in the ink tank are also provided. Radiated light (11) projected into an ink accommodation chamber (5A) excites an illuminant material (10) contained in ink in the ink accommodation chamber (5A) to illuminate. Based on light (12) produced by the illuminant material (10), the amount of ink remaining in the ink accommodation chamber (5A) is detected.

8 Claims, 15 Drawing Sheets

| INK TANK | PRESENT | | ABSENT |
|---|---|---|---|
| INK | PRESENT | ABSENT | — |
| WAVELENGTH OF LIGHT RETURNING FROM INK TANK | λ2 | λ1 | LIGHT NOT DETECTED |

FIG.13

INK TANK FOR LIQUID PRINTING APPARATUS, METHOD OF MANUFACTURING SAME, LIQUID PRINTING APPARATUS WITH SAME, AND METHOD OF DETECTING REMAINING INK

This application is a division of U.S. Application No. 11/667,754, filed May 15, 2007, which was a National Phase submission under 35 U.S.C. §371 of International Application No. PCT/JP2005/023092, filed Dec. 9, 2005, the contents of which are incorporated herein by reference.

TECHNICAL FIELD

The present invention relates to an ink tank capable of detecting ink remaining in the ink tank, a printing apparatus, a method of manufacturing such an ink tank, and a method of detecting the remaining ink.

BACKGROUND ART

Among printing systems to print images including characters on a print medium such as paper and thin plastic sheets (e.g., OHP), there is a liquid printing system that performs contact or noncontact printing on a print surface of the print medium by applying a liquid ink to the print medium.

An ink jet printing system in particular has many advantages, such as a high speed printing, an ease with which a color printing can be made, a capability to print on print mediums such as paper and cloth, small noise, and a capability to produce high quality printed images.

As an ink supply source for a variety of printing apparatus including the ink jet printing apparatus, a cartridge type ink tank is employed. Most of the ink cartridges employed are detachable from the printing apparatus.

The printing apparatus has a mechanism to detect ink remaining in the cartridge to prevent an inadvertent interruption of the printing operation that would otherwise occur when the cartridge runs out of ink. The mechanisms for detecting the presence of the ink remaining in the cartridge include one using a means of detecting a conduction state between electrodes in the cartridge and one using a means for optically detecting ink.

Particularly, the means for optically detecting the presence or absence of ink is simple in construction and does not require a large device and therefore has found many applications.

As an example of such a mechanism for optically detecting a remaining ink, a mechanism using a prism is proposed in U.S. Pat. Nos. 5,616,929 and 6,361,136. The remaining ink detection mechanism using a prism has a light emitting portion and a light receiving portion on the printing apparatus side and, on the ink cartridge side, a prism reflection surface made of a light transmitting material such as polypropylene. When the ink in the cartridge runs out and an interface of the prism changes from ink to air, light from the light emitting portion on the printing apparatus side is totally reflected by the prism reflection surface and detected by the light receiving portion on the printing apparatus side. Based on a change in optical reflection intensity, whether or not there is an ink in the cartridge is determined.

The mechanism that detects the presence or absence of ink in the ink cartridge according to a change in optical reflection intensity, however, has a possibility of the following problem.

When an output of the light emitting portion is increased to improve an accuracy of detecting the remaining ink, unwanted, irregularly reflected rays and scattered rays are produced from the light emitted by the light emitting portion in addition to the reflected light that needs to be detected. These unwanted rays may reach the light receiving portion at a relatively large intensity, making the precise ink detection difficult. Setting high an output threshold for detecting the presence or absence of ink to cope with these irregularly reflected rays and scattered rays of relatively large intensity, however, may pose another problem of a degraded precision of the remaining ink detection and a detection delay.

DISCLOSURE OF THE INVENTION

The present invention has been accomplished in light of these problems. It is an object of this invention to provide an ink tank for a liquid printing apparatus capable of optically detecting the ink remaining in the tank with high precision, a method of manufacturing the ink tank and the liquid printing apparatus, and a method of detecting a remaining ink by the liquid printing apparatus equipped with the ink tank.

To achieve the above objective, the present invention provides an ink tank having an ink accommodation chamber formed therein to accommodate ink, wherein the ink accommodation chamber is capable of accommodating ink, the ink including an illuminant material that illuminates when excited by light radiated from outside; wherein the ink tank has a light path to introduce the radiated light from outside the ink tank into the ink accommodation chamber and to lead light produced by the illuminant material to the outside of the ink tank.

Further, the illuminant material has a light emission wavelength band and a light absorption wavelength band in an ultraviolet range or an infrared range not including a visible light wavelength range. The light emission wavelength band and a peak light emission wavelength of the illuminant material differ from the light absorption wavelength band and a peak light absorption wavelength of the illuminant material, respectively.

The ink tank may also include a light collecting means to collect light produced by the illuminant material.

The light collecting means may include a convex lens.

The light collecting means may include a reflection mirror arranged inside the ink accommodation chamber.

The ink tank may include a diffusing means to diffuse the radiated light into the ink accommodation chamber.

The diffusing means may include a concave lens.

The ink tank may include a reflection means to reflect the radiated light to the outside of the ink tank according to the amount of ink remaining in the ink accommodation chamber.

The ink tank may also include an ink supply port to supply ink from the ink accommodation chamber to a printing apparatus.

The ink tank may have an ink cartridge capable of being attached to and detached from the printing apparatus.

The ink accommodation chamber may accommodate ink.

The present invention also provides a printing apparatus capable of printing an image by using ink supplied from an ink tank; wherein the ink tank has an ink accommodation chamber capable of accommodating ink, the ink including an illuminant material that illuminates when excited by light radiated from outside, and a light path to introduce the radiated light from outside the ink tank into the ink accommodation chamber and to lead light produced by the illuminant material to the outside of the ink tank; wherein the printing apparatus has a light emitting portion to project the radiated light into the ink accommodation chamber through the light path, and a light receiving portion to receive and detect light produced by the illuminant material through the light path.

In the above construction, a wavelength of the light emitted by the light emitting portion may differ from a wavelength of the light received by the light receiving portion.

The printing apparatus may further include a reflected light receiving portion to receive and detect the radiated light reflected from the ink tank according to the amount of ink remaining in the ink accommodation chamber.

The light emitting portion may emit light of peak wavelength $\lambda 1$ having its band in an ultraviolet range or an infrared range; the reflected light receiving portion may have a sensitivity of detecting light of wavelength $\lambda 1$; and the light receiving portion may have a sensitivity of detecting light of peak wavelength $\lambda 2$ having its band in an ultraviolet range or an infrared range different from the wavelength $\lambda 1$.

The printing apparatus may print an image by using an ink jet print head capable of ejecting ink supplied from the ink tank.

The present invention also provides a method of manufacturing an ink tank, wherein the ink tank has an ink accommodation chamber capable of accommodating ink, the method comprising the steps of: preparing a case in which at least the ink accommodation chamber is formed; forming an ink supply portion to communicate the ink accommodation chamber in the case with the outside of the ink tank; forming a light path to introduce radiated light projected from outside the ink tank into the ink accommodation chamber and to lead light produced in the ink accommodation chamber to the outside of the ink cartridge; dissolving or dispersing in ink an illuminant material that illuminates when excited by the radiated light projected from outside the ink cartridge; and filling the ink dissolved or dispersed with the illuminant material into the ink accommodation chamber.

The method of manufacturing an ink tank may further include the step of: providing a light collecting means to collect light produced by the illuminant material.

The present invention also provides a method of detecting ink remaining in an ink accommodation chamber, comprising the steps of: projecting radiated light into the ink accommodation chamber; exciting an illuminant material contained in the ink in the ink accommodation chamber with the radiated light to produce light; and detecting the ink remaining in the ink accommodation chamber according to the light produced by the illuminant material.

As described above, this invention projects the radiated light into the ink accommodation chamber to excite the illuminant material contained in ink in the ink accommodation chamber to illuminate. By detecting light produced by the illuminant material, which has a different wavelength than that of the radiated light, it is possible to detect the ink remaining in the ink accommodation chamber.

That is, whether or not there is ink remaining in the ink accommodation chamber can reliably be determined by detecting the light produced by the illuminant material in the ink, without being affected by scattered rays or irregularly reflected rays of the radiated light.

For example, a threshold of light quantity or intensity for checking the presence of ink may be set low to secure a large S/N ratio of the detection light quantity and thereby enable the presence or absence of the remaining ink to be detected with high precision.

It is also possible to detect whether the ink tank is mounted on the printing apparatus and thus prevent the printing operation from being executed without mounting the ink tank.

The above and other objects, effects, features and advantages of the present invention will become more apparent from the following description of embodiments thereof taken in conjunction with the accompanying drawings.

BRIEF DESCRIPTION OF THE DRAWINGS

FIG. 13 is a decision table to determine the presence or absence of ink according to the fourth embodiment of the invention;

BEST MODE FOR CARRYING OUT THE INVENTION

Embodiments of this invention will be described by referring to the accompanying drawings.

First Embodiment

Figure 1:
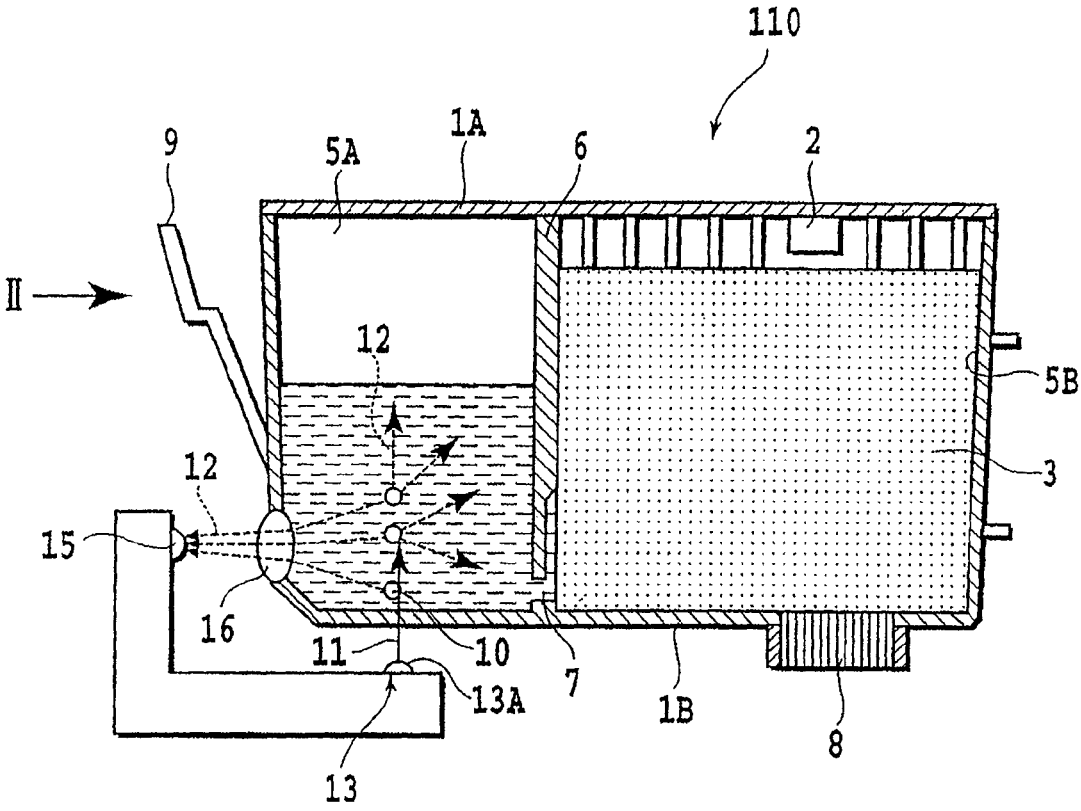
FIG. 1 is a cross-sectional view of an ink cartridge containing ink according to a first embodiment of this invention.
Figure 2:
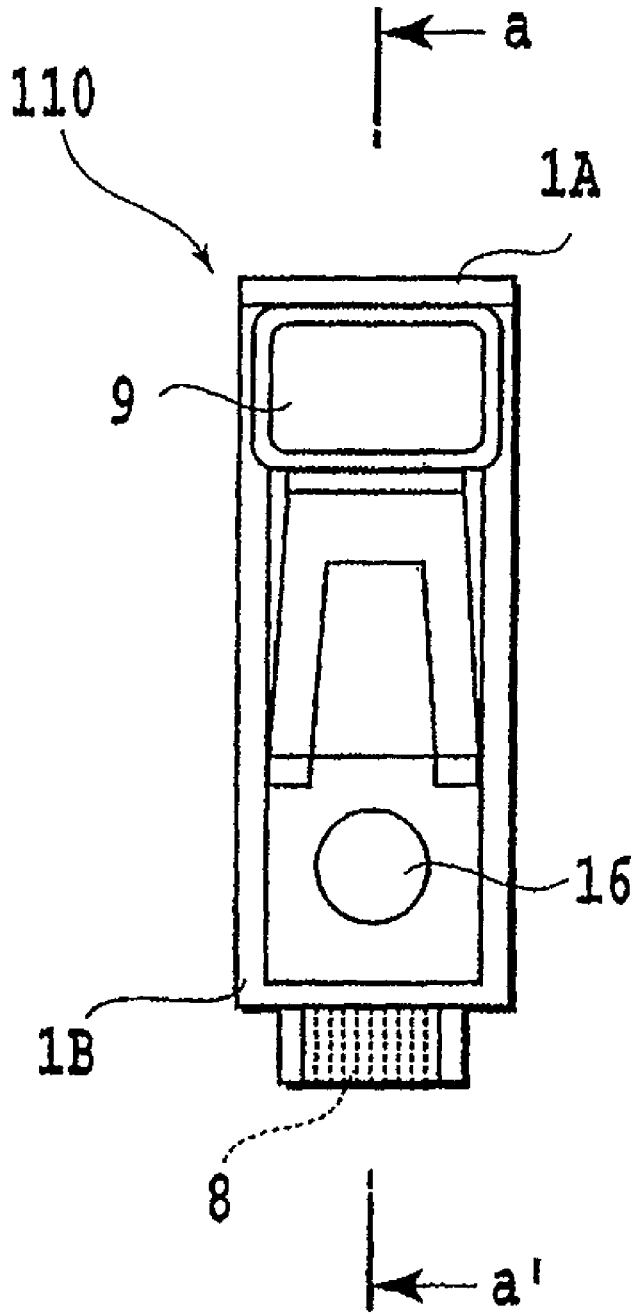
FIG. 2 is a side view of the ink cartridge as seen from a direction II of FIG. 1 according to the first embodiment of the invention.

As shown in FIG. 1 and FIG. 2, a body of an ink cartridge 110 in this embodiment is constructed of a cover member 1A and a case member 1B joined together. Its interior is divided by a partition wall 6 into an ink accommodation chamber 5A and an absorber accommodation chamber 5B. The absorber accommodation chamber 5B is formed with an atmosphere communication port 2 communicating with an atmosphere and an ink supply port 8 to supply ink to an ink jet print head not shown. Installed in the absorber accommodation chamber 5B is an absorber 3 which absorbs and holds ink by capillary attraction and applies a negative pressure to the ink being supplied from the ink supply port 8. The ink accommodation chamber 5A communicates with the absorber accommodation chamber 5B through only a communication port 7.

As ink is consumed by the print head connected to the ink supply port 8, the ink in the absorber accommodation chamber 5B is supplied to the print head from the ink supply port 8 under a predetermined negative pressure applied by the absorber 3. As the amount of ink remaining in the absorber accommodation chamber 5B decreases, the ink in the ink accommodation chamber 5A is supplied into the absorber accommodation chamber 5B through the communication port 7 by the air-liquid exchange. A pressure difference between the ink accommodation chamber 5A and the absorber accommodation chamber 5B causes the ink in the ink accommodation chamber 5A to move into the absorber accommodation chamber 5B through the communication port 7. At the same time, air in the absorber accommodation chamber 5B is introduced into the ink accommodation chamber 5A. By this process the ink cartridge 110 can stably supply the ink under a predetermined pressure from the ink supply port 8.

Figure 3:
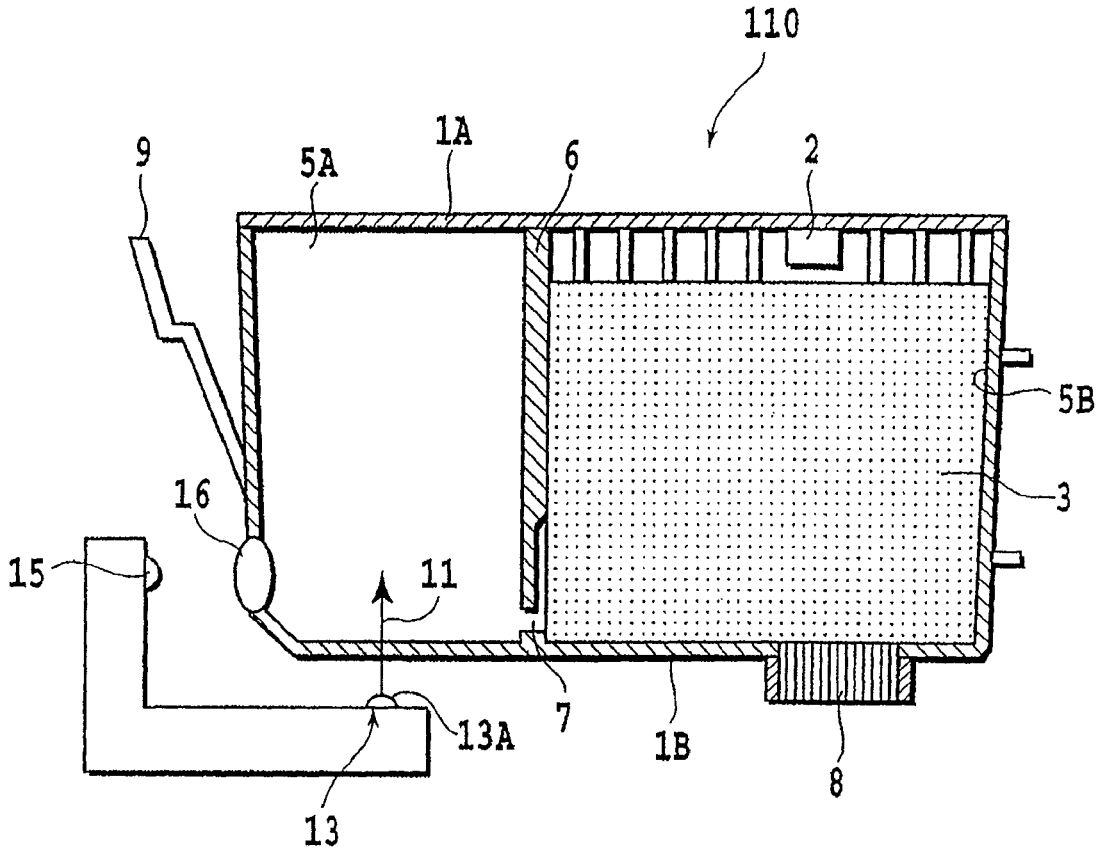
FIG. 3 is a cross-sectional view of the ink cartridge with no ink in it according to the first embodiment of the invention.

FIG. 1 is a cross section of the ink cartridge 110 with ink present in the ink accommodation chamber 5A, and FIG. 2 is a side view as seen from a direction of arrow II of FIG. 1. FIG. 1 corresponds to a cross section taken along the line a-a' of FIG. 2. FIG. 3 is a cross section of the ink cartridge 110 with no ink present in the ink accommodation chamber 5A.

This embodiment is designed to detect the ink remaining in the ink accommodation chamber 5A of the ink cartridge 110. For this purpose, the ink accommodation chamber 5A is formed of a transparent resin material that transmits light of a specific wavelength described later.

The ink jet printing apparatus using the ink cartridge 110 has a light emitting unit (light emitting portion) 13 with a built-in light emitting diode (not shown). Light from the light emitting diode is concentrated by a dome-shaped collective lens 13A and projected perpendicularly toward the bottom of the ink accommodation chamber 5A. Let the wavelength of the projected light 11 be λ1. The ink accommodated in the ink accommodation chamber 5A and absorber accommodation chamber 5B has an illuminant material 10 dispersed therein. The projected light 11 of wavelength λ1 emitted from the light emitting unit 13 passes through the bottom wall of the ink accommodation chamber 5A that is transparent to this wavelength, and is radiated against the ink. The illuminant material 10 dispersed in the ink absorbs the projected light 11 of the wavelength λ1 and is excited to produce light 12 of wavelength λ2, which is different from the wavelength λ1.

On the ink jet printing apparatus side, a first light receiving unit (first light receiving portion) 15 is located near and outside the ink cartridge 110. The first light receiving unit 15 has a function (sensitivity) to detect light 12 of wavelength λ2. A wall of the ink accommodation chamber 5A is integrally formed with a light collecting member 16 that is situated between the first light receiving unit 15 and the ink in the ink accommodation chamber 5A. The light collecting member 16 is a convex lens and efficiently collects light 12 emitted by the illuminant material 10 dispersed in the ink, regardless of the ink volume in the ink accommodation chamber 5A, and introduces the collected light into the first light receiving unit 15.

As described above, this embodiment uses the projected light 11 to excite the illuminant material 10 to produce light. The projected light 11 is radiated from the light emitting unit 13 against the ink in the ink accommodation chamber 5A to excite the illuminant material dispersed in the ink. The light 12 produced by the illuminant material 10 is then detected by the first light receiving unit 15. With this process the ink remaining in the ink accommodation chamber 5A is detected.

When there is ink in the ink accommodation chamber 5A as shown in FIG. 1, the illuminant material 10 in the ink absorbs the excitation light 11 of wavelength λ1 projected from the light emitting unit 13 toward the ink in the ink accommodation chamber 5A. The illuminant material thus excited now produces light 12 of wavelength λ2, which is different from the wavelength λ1 of the excitation light 11. A part of the light 12 produced by the illuminant material 10 is collected by the light collecting member 16 for detection by the first light receiving unit 15.

When on the other hand the ink accommodation chamber 5A is empty of ink as shown in FIG. 3, there is no illuminant material 10 in the ink accommodation chamber 5A. Thus, radiating the excitation light 11 does not produce light 12. Nor does the first light receiving unit 15 detect it.

As described above, whether or not the light 12 produced by the illuminant material 10 is detected by the first light receiving unit 15 determines the presence or absence of the ink in the ink accommodation chamber 5A.

The first light receiving unit 15 is constructed to detect the light 12 of wavelength λ2 produced by the illuminant material 10 but not detect the excitation light 11 of wavelength λ1 from the light emitting unit 13. For example, a filter to cut a particular wavelength range is provided in the first light receiving unit 15 to reduce or cut the excitation light 11 of wavelength λ1 to such a degree that it is not detectable by the first light receiving unit 15. Should scattered rays and irregularly reflected rays of the excitation light 11 get to or near the first light receiving unit 15, they are reduced or cut in intensity by the filter and thus not detected by the first light receiving unit 15. The first light receiving unit 15 therefore can reliably detect the light 12 of wavelength λ2 without being affected by the excitation light 11 of wavelength λ1. This makes it possible to detect the presence or absence of ink in the ink accommodation chamber 5A with high precision. Further, when the ink cartridge 110 is not mounted, the first light receiving unit 15 does not detect the light 12. This means that the presence or absence of the ink cartridge 110 can also be detected.

The light collecting member 16 installed in the ink cartridge 110 collects scattered rays of light 12 emitted by the illuminant material 10 and introduces it into the first light receiving unit 15. If the ink in the ink accommodation chamber 5A is running low, the light 12 emitted by the illuminant material 10 can be collected and reach the first light receiving unit 15 as long as the ink exists. Thus the accuracy of detecting the remaining ink can further be improved.

The illuminant material 10 is a substance that illuminates by the optical excitation, such as fluorescent material and phosphorescent material. Among them, a suitable material is one that does not absorb light and illuminate in a visible light range. The illuminant material 10 functions effectively for the detection of the remaining ink and for the detection of presence or absence of the ink cartridge 110. Further, it is important that when an image is printed on a print medium with the ink containing the illuminant material, the ink originally adjusted to be a printing liquid not be degraded in its chromaticity and color saturation. For example, the illuminant material 10 may be a material that is not excited to illuminate by the light visible to human eye.

Examples of the illuminant material 10 include an inorganic, infrared phosphor containing niobium (Nb), ytterbium (Yb) and erbium (Er), as disclosed in U.S. Pat. No. 5,932,139 and Japanese Patent Application Nos. 08-003548 and 60-029996. There is also an infrared illuminant material containing polyester, as disclosed in U.S. Pat. Nos. 5,093,147, 5,614,008, 4,540,595 and 5,990,197. It is also possible to use known materials such as infrared illuminant materials containing phthalocyanine, as disclosed in U.S. Pat. Nos. 6,149,719 and 6,513,921.

The illuminant material 10 may be an ultraviolet illuminant material having a light absorption and emission band in an invisible light range. When an infrared phosphor is used as the illuminant material 10, the wavelength of light 11 projected from the light emitting unit 13 and the wavelength detected by the first light receiving unit 15 are both in the invisible light range, so that GaAs and GaAlAs are suited for the material of the light emitting unit 13. For the material of the first light receiving unit 15, InGaAs and Si are suited.

For ink cartridges containing different color inks, the presence or absence of the remaining ink can also be detected using the same system. In this case, to prevent possible variations in the remaining ink detection accuracy that may be caused by a light intensity difference among lights received by the first light receiving unit 15 from the color inks of different kinds and densities, the concentrations of the illuminant material 10 in these inks are adjusted according to the kind and density of the inks.

(Example Construction of Printing Apparatus)

Figure 14:
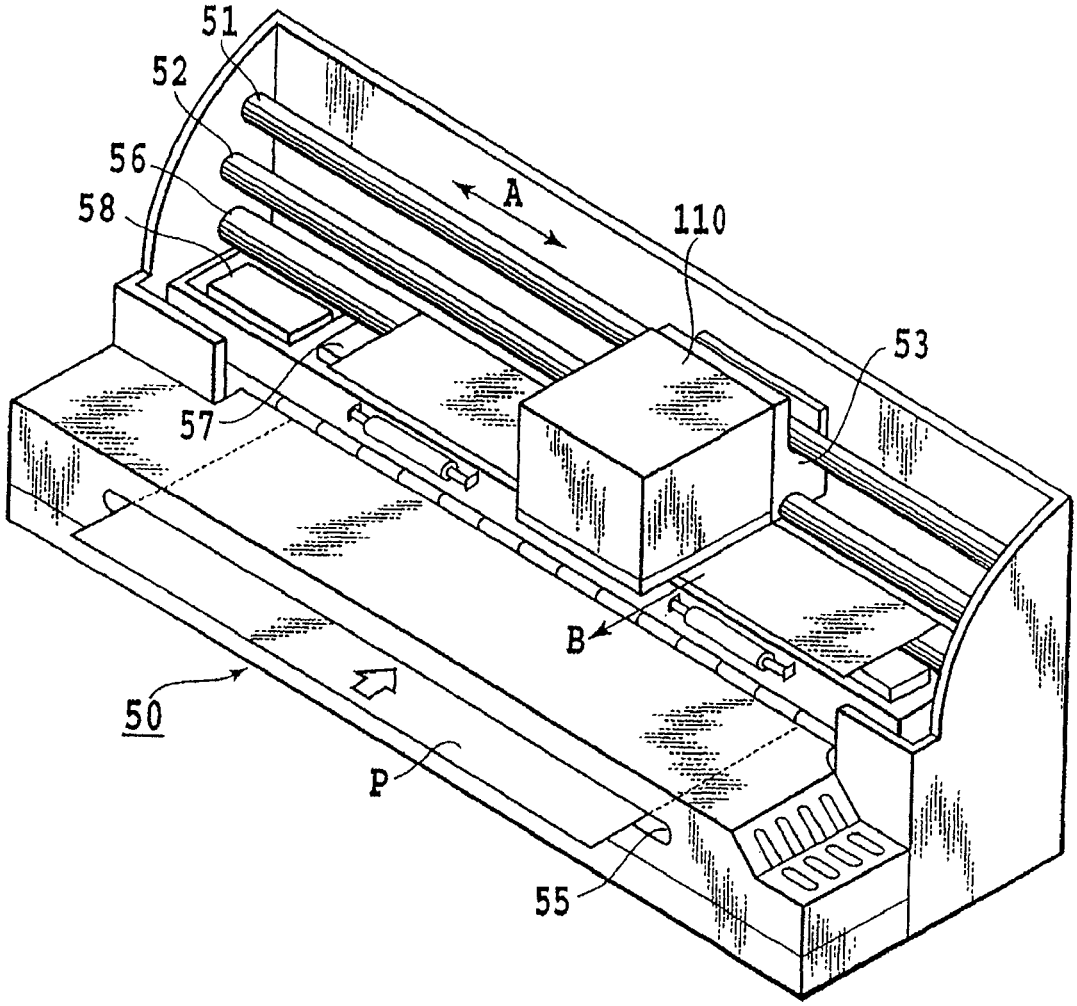
FIG. 14 is a schematic perspective view showing an example construction of a printing apparatus to which this invention can be applied.

FIG. 14 is a schematic perspective view showing an example construction of a printing apparatus to which the present invention can be applied.

The printing apparatus 50 in this example is of a serial scan type and has a carriage 53 movably guided on guide shafts 51, 52 so that it is movable in a main scan direction indicated by arrow A. The carriage 53 is reciprocally driven in the main scan direction by a carriage motor and a drive force transmission mechanism, such as a belt, that transmits a drive force of the carriage motor. The carriage 53 mounts a print head 10 (see FIG. 15) and an ink tank to supply ink to the print head 10. The print head 10 and the ink tank may form the ink jet cartridge. The ink cartridge 110 described earlier may be mounted as the ink tank. The ink in the ink cartridge 110 is supplied through the ink supply port 8 to the print head 10. The ink cartridge 110 can be attached to or detached from an ink cartridge mounting portion provided at a predetermined position on the carriage 53 or print head 10 by using a mounting lever 9 (see FIG. 1). With the ink cartridge 110 mounted, the left side of FIG. 1 is normally a front side of the printing apparatus.

The print head 10, which is supplied ink from the ink cartridge 110 and applies it to a print medium to form an image, uses an ink jet print head capable of ejecting ink from its nozzles. A variety of kinds of ink jet print head may be used, such as one using electrothermal transducers (heaters) or one using piezoelectric elements to eject ink. When the electrothermal transducers are used, they heat the ink to form a bubble in ink that expels an ink droplet from the nozzle as the bubble expands.

Paper P as a print medium is inserted from an insertion opening 55 at the front of the printing apparatus 50, reversed in its transport direction and fed in a sub scan direction of arrow B by a feed roller 56. The printing apparatus 50 performs a printing operation by causing the print head 10 to eject ink toward a print area of the paper P on a platen 57 as the print head travels in the main scan direction. By repetitively alternating the printing operation and a feed operation that feeds the paper P in the sub scan direction by a distance equal to the print width of each main scan.

At the left end of a main scan stroke range of the carriage 53 in FIG. 14, a recovery unit (recovery operation means) 58 is installed which faces a nozzle forming surface of the print head 10 mounted on the carriage 53. The recovery unit 58 has a cap capable of capping the nozzles of the print head 10 and a suction pump for introducing a negative pressure into the cap. The recovery operation (also referred to as a "suction-based recovery operation") is performed by introducing the negative pressure into the cap that closes the nozzles, to suck out ink from the nozzles to keep the ink ejection performance of the print head 10 in good condition. The recovery operation to keep the ink ejection performance of the print head 10 in good condition can also be done by ejecting ink, not contributing to the image formation, from the nozzles into the cap (also called an "ejection-based recovery operation").

The printing apparatus 50 has the light emitting unit 13 and the light receiving unit 15 (not shown in FIG. 14) so arranged that they face the ink accommodation chamber 5A of the ink cartridge 110, as shown in FIG. 1, when the carriage 53 reaches a predetermined position for detection of the remaining ink. The remaining ink detection position may be set at a home position where the recovery unit 58 is installed. In this case, the remaining ink can be detected when the carriage 53 moves to the home position as during the standby state of the print head 10, during the recovery operation and during a halted state of the printing operation.

Figure 15:
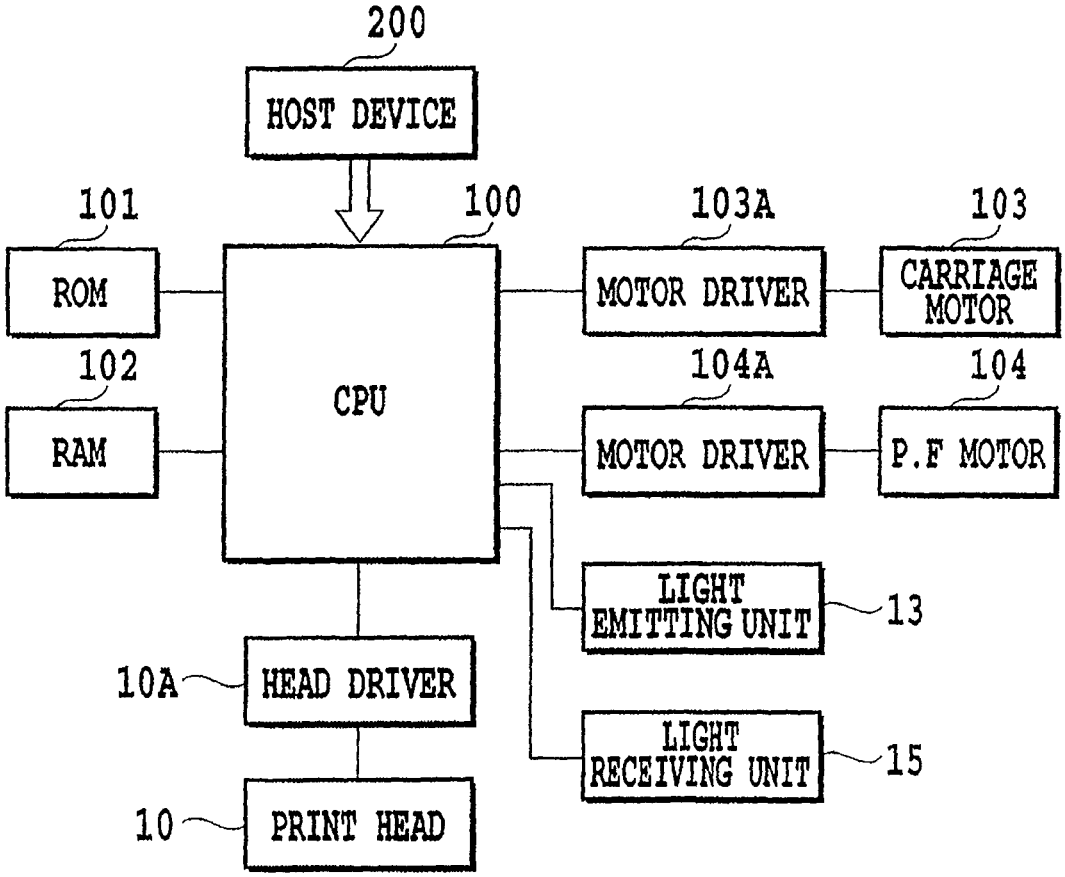
FIG. 15 is a block diagram of a remaining ink detection system in the printing apparatus to which this invention can be applied.

FIG. 15 is a schematic block diagram of a control system in the printing apparatus of FIG. 14.

In FIG. 15, a CPU 100 executes control processing for the operation of the printing apparatus and data processing. A ROM 101 stores programs such as processing procedures, and a RAM 102 is used as a work area for executing processing. Ink ejection from the head 10 is done by the CPU 100 supplying heater drive data (image data) and a drive control signal (heat pulse signal) to the head driver 10A. The CPU 100 controls the carriage motor 103 through a motor driver 103A to drive the carriage 53 in the main scan direction. It also controls a P.F motor 104 through a motor driver 104A to feed the paper P in the sub scan direction.

In performing the detection of the remaining ink in the ink cartridge 110, the CPU 100 moves the carriage 53 to the remaining ink detection position to have the ink accommodation chamber 5A of the ink cartridge 110 face the light emitting unit 13 and the light receiving unit 15. Excitation light 11 is radiated from the light emitting unit 13 into the ink accommodation chamber 5A. The light receiving unit 15 decides the presence or absence of the ink remaining in the ink accommodation chamber 5A according to whether the light 12 produced by the illuminant material 10 is detected or not. Further, the CPU 100 executes processing in response to the result of the detection. For example, when it is found that there is no ink remaining, the CPU interrupts the printing operation or prompts the user to replace the ink cartridge 110 with a new one.

Second Embodiment

Figure 4:
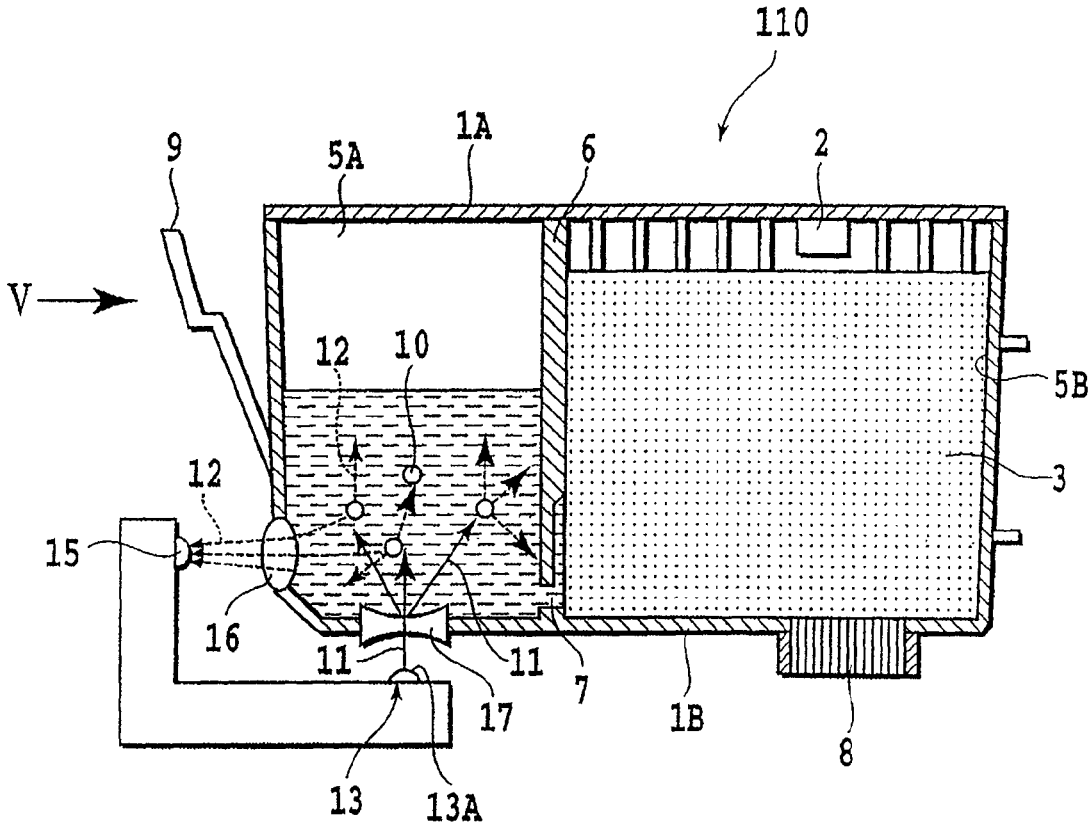
FIG. 4 is a cross-sectional view of an ink cartridge containing ink according to a second embodiment of this invention.
Figure 5:
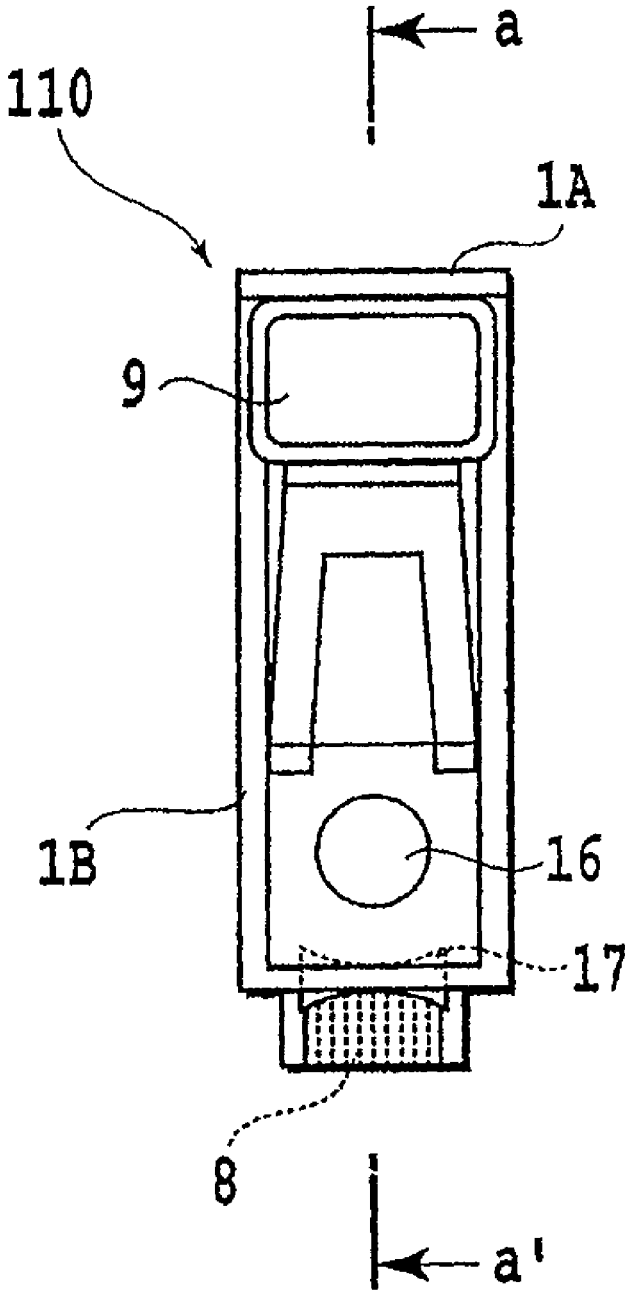
FIG. 5 is a side view of the ink cartridge as seen from a direction V of FIG. 4 according to the second embodiment of the invention.

FIG. 4 and FIG. 5 illustrate a second embodiment of this invention. FIG. 4 is a cross-sectional view showing the ink cartridge 110 with ink present in the ink accommodation chamber 5A, and FIG. 5 is a side view as seen from a direction of arrow V of FIG. 4. FIG. 4 is a cross section taken along the line a-a' of FIG. 5.

This embodiment differs from the first embodiment in that the ink cartridge 110 is provided with a diffusing member 17 to diffuse the excitation light 11 from the light emitting unit 13. In this example, a concave lens is used as the diffusing member 17. The concave lens is made of a resin transparent to the excitation light 11, more specifically polypropylene of transparent grade, and formed integral with the ink accommodation chamber 5A. The excitation light 11 that has passed through the concave lens 17 is diffused so that an average light intensity in ink in the ink accommodation chamber 5A lowers. However, if the excitation light 11 from the light emitting unit 13 is set strong enough so that the light intensity from the illuminant material 10 saturates, the provision of the concave lens enables the excitation light 11 to be effectively radiated against the illuminant material 10 dispersed in a wide range. As a result, the amount of illuminant material 10 excited increases, thus increasing the quantity of light 12 detected by the light receiving unit 15 and improving the remaining ink detection accuracy.

Third Embodiment

Figure 6:
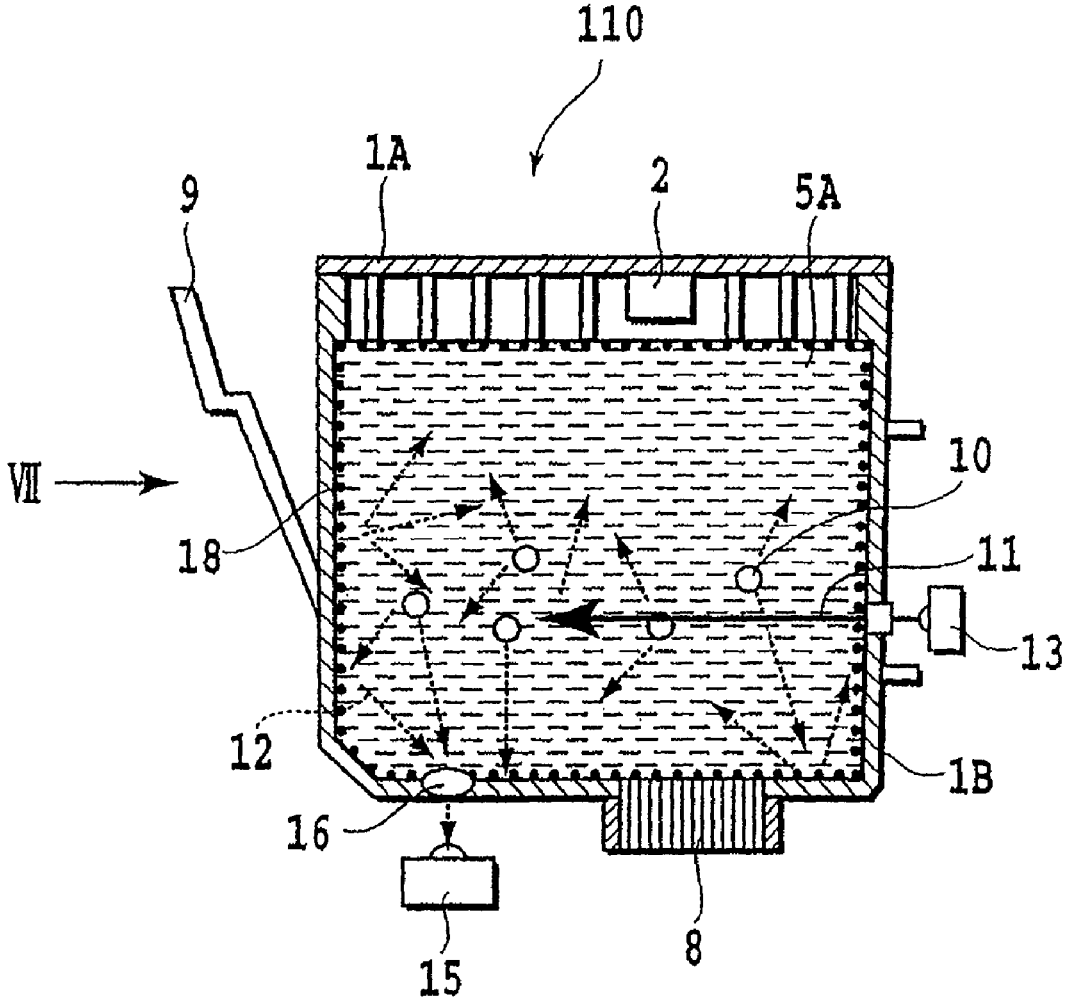
FIG. 6 is a cross-sectional view of an ink cartridge containing ink according to a third embodiment of this invention.
Figure 7:
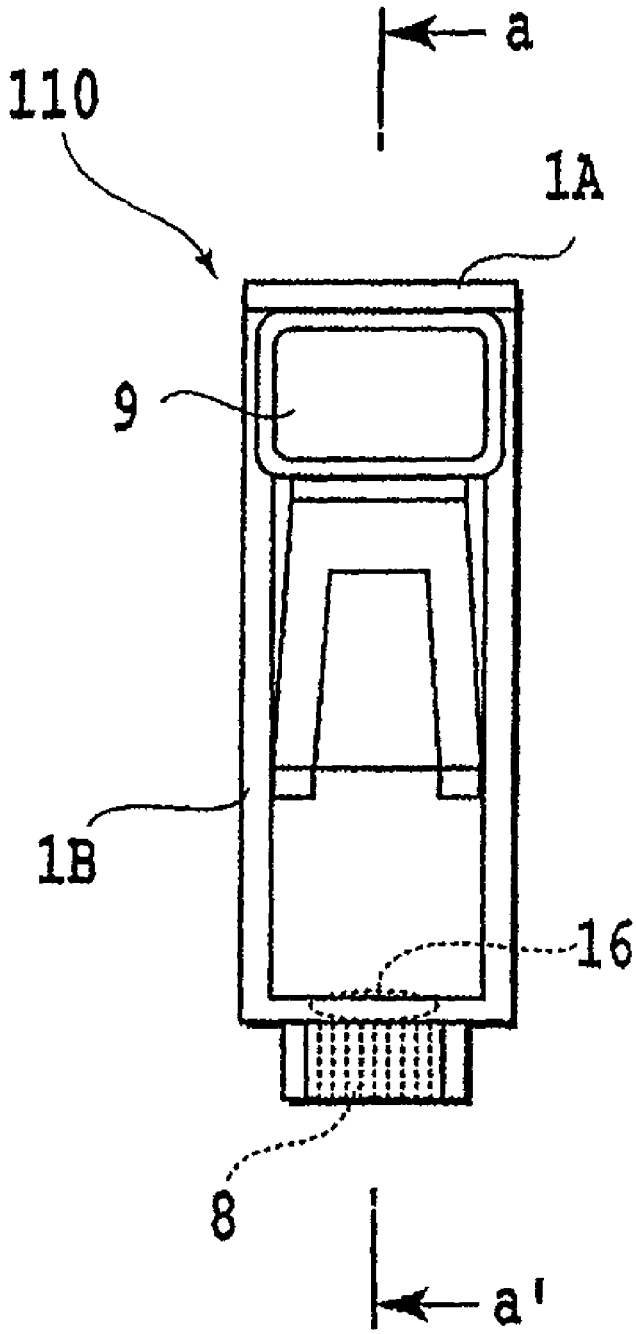
FIG. 7 is a side view of the ink cartridge as seen from a direction VII of FIG. 6 according to the third embodiment of the invention.
Figure 8:
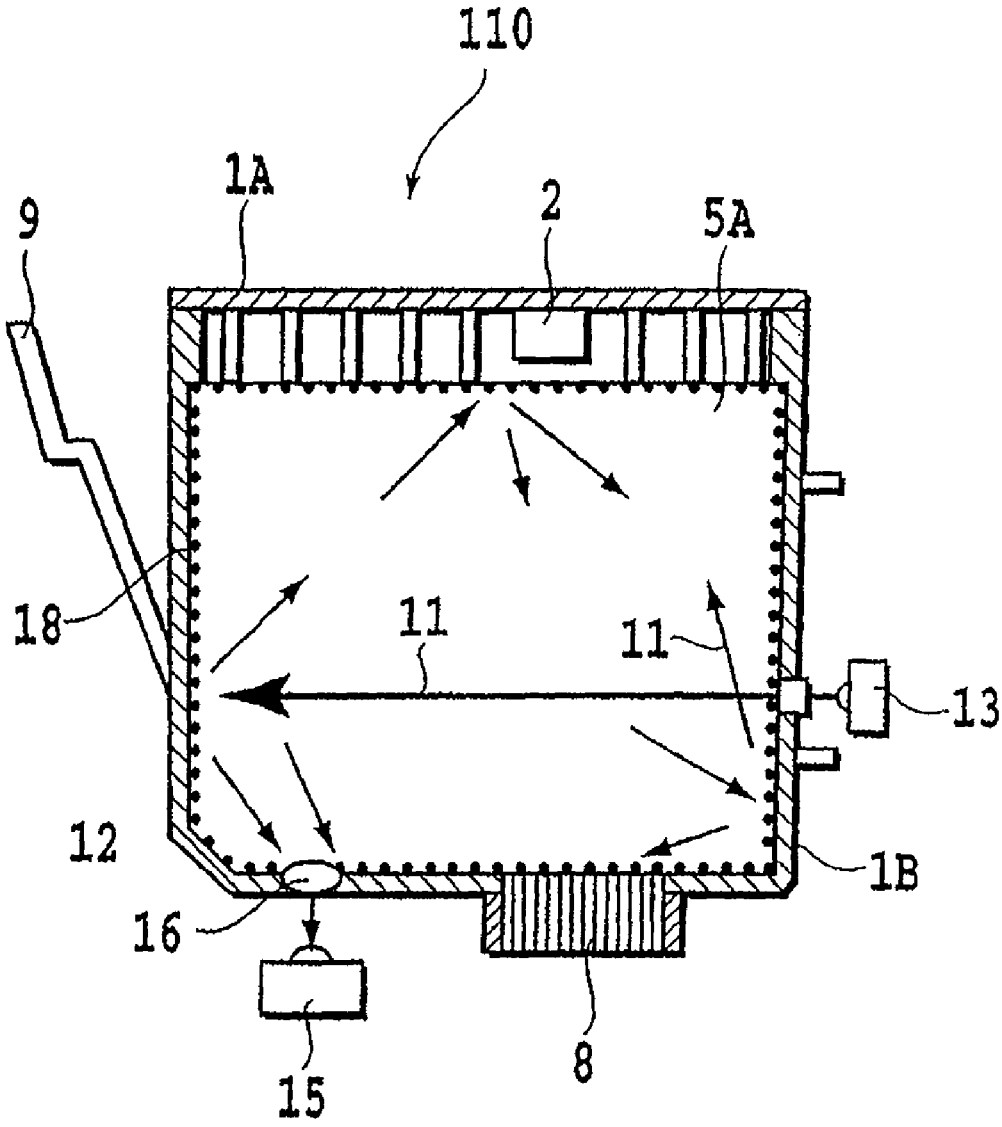
FIG. 8 is a cross-sectional view of the ink cartridge with no ink in it according to the third embodiment of the invention.

FIG. 6 to FIG. 8 illustrate a third embodiment of this invention. FIG. 6 is a cross-sectional view showing the ink cartridge 110 with ink present in the ink accommodation chamber 5A, FIG. 7 is a side view as seen from a direction of arrow VII of FIG. 6, and FIG. 8 is a cross-sectional view showing the ink cartridge 110 with no ink present in the ink accommodation chamber 5A. FIG. 6 is a cross section taken along the line a-a' of FIG. 7.

In the previous embodiment the ink cartridge 110 has the ink accommodation chamber 5A and the absorber accommodation chamber 5B. The ink cartridge 110 needs only to form an ink tank having the ink accommodation chamber 5A. For example, the ink accommodation chamber 5A may be formed inside a resilient baglike cartridge or it may be formed using almost the entire space in the ink cartridge 110 for directly accommodating ink.

In this embodiment, the ink accommodation chamber 5A is constructed to directly accommodate ink in almost the entire space inside the ink cartridge 110. The basic function of this embodiment is similar to that of the first embodiment. This embodiment further provides a reflection mirror 18 inside the ink cartridge 110. The reflection mirror 18 collects the light 12 produced by the illuminant material 10, increases the quantity or intensity of light and introduces it to the first light receiving unit 15, thus improving the detection accuracy of the remaining ink.

Fourth Embodiment

Figure 9:
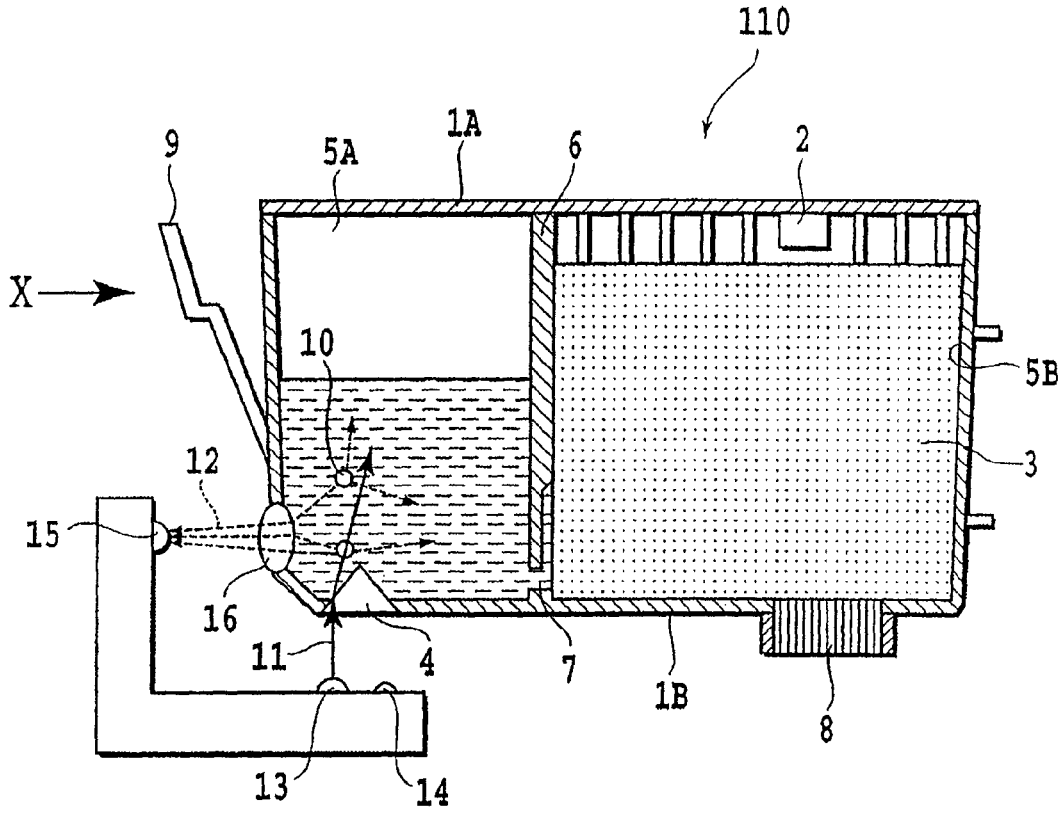
FIG. 9 is a cross-sectional view of an ink cartridge containing ink according to a fourth embodiment of this invention.
Figure 10:
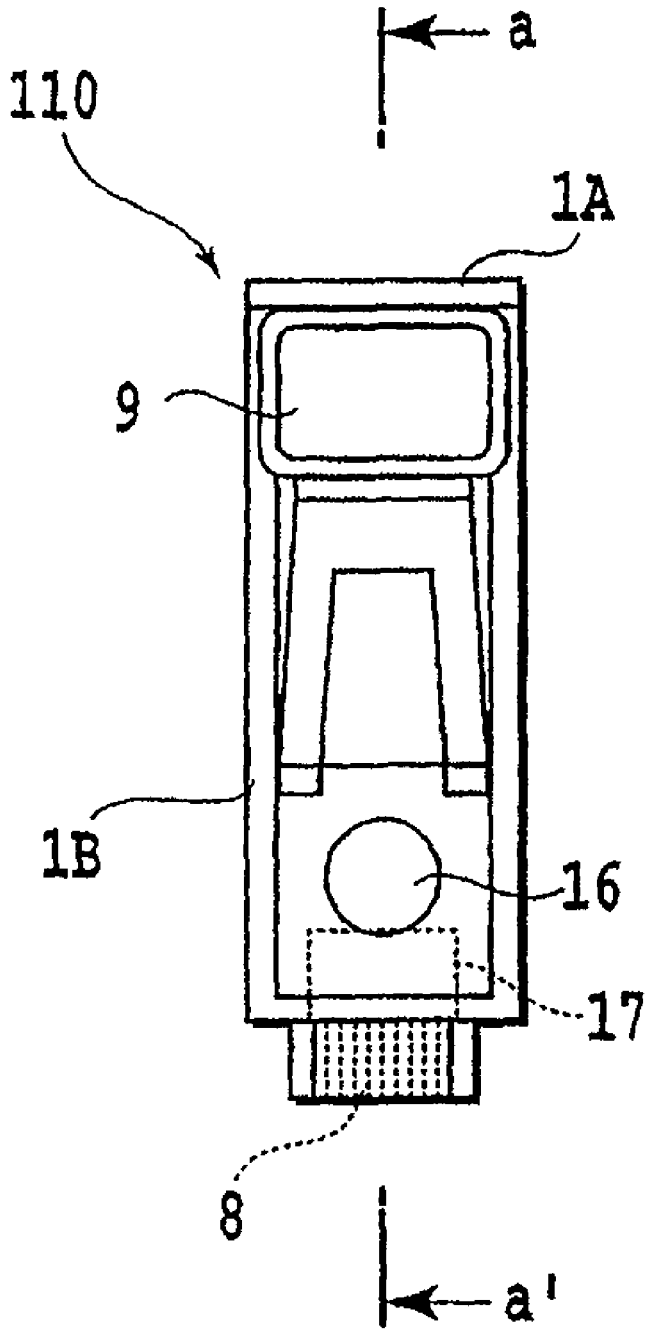
FIG. 10 is a side view of the ink cartridge as seen from a direction X of FIG. 9 according to the fourth embodiment of the invention.
Figure 11:
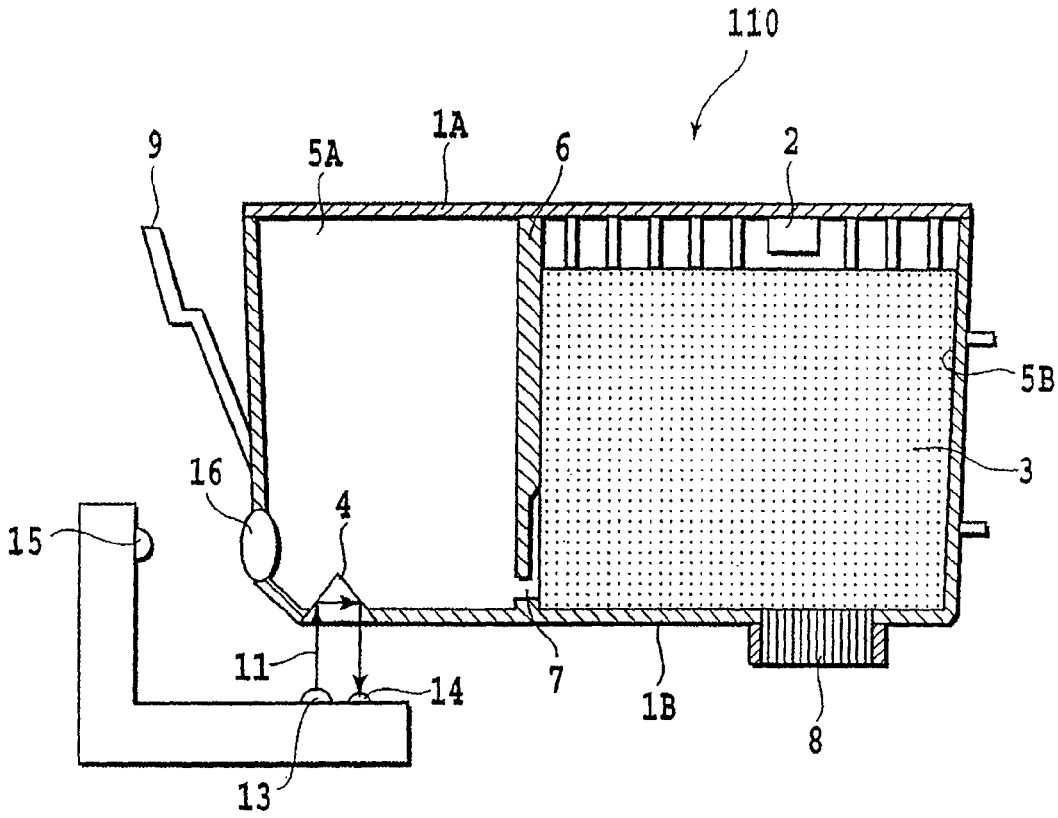
FIG. 11 is a cross-sectional view of the ink cartridge with no ink in it according to the fourth embodiment of the invention.

FIG. 9 to FIG. 12 illustrate a fourth embodiment of this invention. FIG. 9 is a cross-sectional view showing the ink cartridge 110 with ink present in the ink accommodation chamber 5A, FIG. 10 is a side view as seen from a direction of arrow X of FIG. 9, and FIG. 11 is a cross-sectional view showing the ink cartridge 110 with no ink present in the ink accommodation chamber 5A. FIG. 9 is a cross section taken along the line a-a' of FIG. 10.

The basic function of this embodiment is similar to that of the first embodiment. This embodiment differs from the first embodiment in that a triangular prism 4 is installed in the ink cartridge 110 and that a second light receiving unit (second light receiving portion) 14 is provided on the printing apparatus side. The second light receiving unit 14 has a function of detecting the projected light 11 of wavelength λ1 radiated from the light emitting unit 13. When there is no ink in the ink accommodation chamber 5A as shown in FIG. 11, the second light receiving unit 14 detects the projected light 11 totally reflected by the prism 4. When ink exists in the ink accommodation chamber 5A as shown in FIG. 9, the illuminant material 10 excited by the projected light 11 produces light 12 of wavelength λ2, which is then detected by the first light receiving unit 15.

Figure 12:
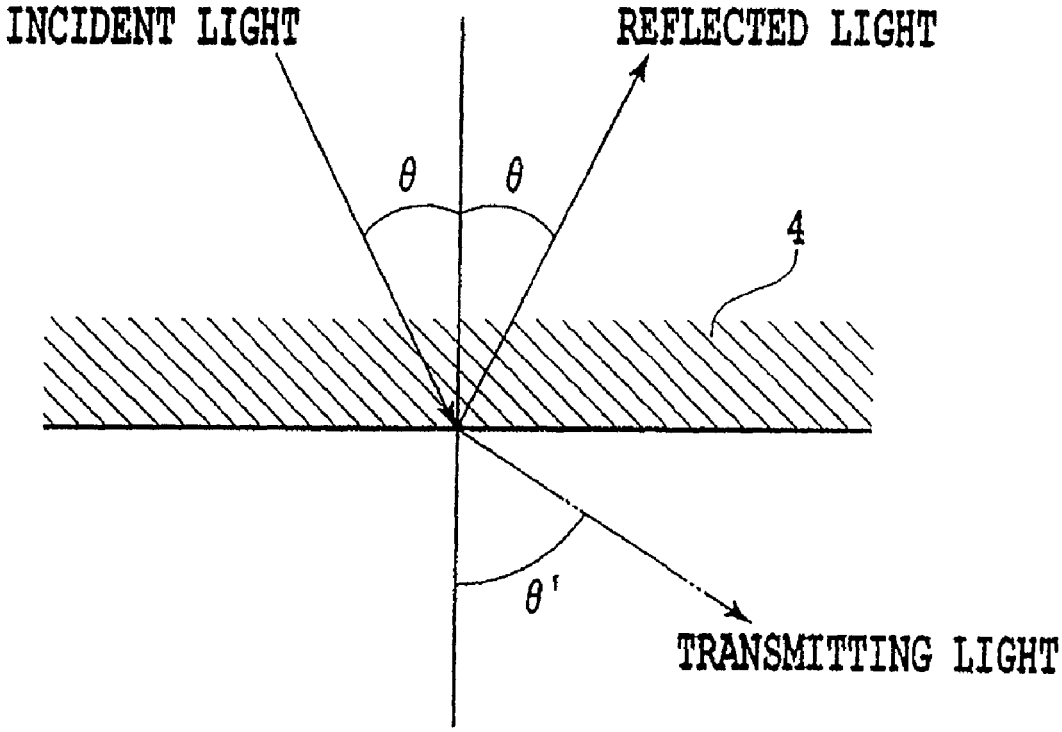
FIG. 12 illustrates light paths in a prism of the ink cartridge of the fourth embodiment of the invention.

FIG. 12 is a conceptual diagram showing how the triangular prism 4 works when light enters the surface of the triangular prism 4 at an incidence angle of θ. When in FIG. 12 there is air beneath the prism 4, the incident light is reflected by an interface between the air and the triangular prism 4, with a reflection angle of the reflected light equal to the incidence angle of θ. This represents a situation in which no ink exists in the ink accommodation chamber 5A as in FIG. 11. When on the other hand there is ink below the triangular prism 4 in FIG. 12, the incident light is refracted through the interface between the ink and the triangular prism 4 at a refraction angle θ' and propagates as a transmitting light indicated by two-dot chain line in FIG. 12. This represents a situation in which there is ink in the ink accommodation chamber 5A as in FIG. 9.

The second light receiving unit 14, as described above, detects the projected light 11 of wavelength λ1 radiated from the light emitting unit 13. The first light receiving unit 15 on the other hand detects the light 12 of wavelength λ2 produced by the illuminant material 10 when excited by the projected light 11. Thus, when none of the first light receiving unit 15 and the second light receiving unit 14 detects light, it can be determined that the ink cartridge 110 is not mounted. When the first light receiving unit 15 detects light (light 12 of wavelength λ2), it can be decided that ink exists in the ink accommodation chamber 5A. Further, when the first light receiving unit 15 fails to detect light (light 12 of wavelength λ2) and the second light receiving unit 14 detects light (light 11 of wavelength λ1), it can be decided that there is no ink in the ink accommodation chamber 5A of the mounted ink cartridge 110.

FIG. 13 explains about the above three decisions. When the ink cartridge 110 as an ink tank is mounted and if there is no ink in it, the projected light of wavelength λ1 is detected. If there is ink, the light 12 of wavelength λ2 is detected. When the ink cartridge 110 is not mounted, neither the light 11 of wavelength λ1 nor the light 12 of wavelength λ2 is detected. In this way, the presence of ink and whether the ink cartridge is mounted or not can be checked by the combination of the detected lights of wavelength λ1 and λ2.

Since the first and second light receiving units 15 and 14 have different detectable ranges of wavelength, there is no possibility of an erroneous detection occurring even under a situation where the illuminant material 10 produces scattered light 12.

Fifth Embodiment

The method of manufacturing the ink cartridge (ink tank) 110 can include the following steps.

A step of preparing a case in which at least a space (ink accommodation space) to accommodate ink is formed; a step of forming an ink supply portion to communicate the ink accommodation space in the case with the outside; a step of providing a light collecting device for collecting light produced inside the ink cartridge and/or a light path to lead the collected light to the outside of the ink cartridge; a step of dissolving or dispersing in ink an illuminant material that illuminates when excited by an external light radiated from outside the ink cartridge; and a step of filling the ink thus obtained into the ink accommodation space. These steps in combination can manufacture the ink cartridge (ink tank) 110.

This invention can be applied widely to those printing apparatus using a variety of print heads that apply ink to a print medium, in addition to the ink jet printing apparatus. Further, the printing apparatus is not limited to the serial scan type and may also be a full line type printing apparatus that uses an elongate print head extending over an entire width of a print area of the print medium.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes.

This application claims priority from Japanese Patent Application No. 2004-357302 filed Dec. 9, 2004, filed which is hereby incorporated by reference herein.

The invention claimed is:

1. An ink tank accommodating ink, comprising:

an ink accommodation chamber; and ink accommodated in the ink accommodation chamber, the ink including an illuminant material that illuminates when excited by a light radiated from outside;

wherein the ink accommodation chamber has a first part to introduce the light radiated from outside into the accommodation chamber and a second part to lead a light produced by the illuminant material to the outside of the ink accommodation chamber, wherein the ink accommodation chamber has a light collecting unit to collect the light produced by the illuminant material and increase its quantity.

2. The ink tank according to claim 1, wherein the ink accommodation chamber has an optical diffusing unit to diffuse the light radiated from outside into the ink accommodation chamber.

3. The ink tank according to claim 1, wherein the ink accommodation chamber has an optical prism, the optical prism passing the light radiated from outside in a situation in which ink exists in the ink accommodation chamber and reflecting the light radiated from outside in a situation in which no ink exists in the ink accommodation chamber.

4. The ink tank according to claim 1, wherein the illuminant material has a light emission wavelength band and a light absorption wavelength band in an ultraviolet range or an infrared range not including a visible light wavelength range, wherein the light emission wavelength band and a peak light emission wavelength of the illuminant material differ from the light absorption wavelength band and a peak light absorption wavelength of the illuminant material, respectively.

5. The ink tank according to claim 1, wherein the illuminant material receives light of peak wavelength $\lambda 1$ having its band in an ultraviolet range or an infrared range to produce light of peak wavelength $\lambda 2$ having its band in an ultraviolet range or an infrared range different from the wavelength $\lambda 1$.

6. A printing apparatus for printing an image by using ink supplied from an ink tank, comprising:

the ink tank having an ink accommodation chamber and ink accommodated in the ink accommodation chamber, the ink including an illuminant material that illuminates when excited by a light radiated from outside, the ink accommodation chamber having a first part to introduce the light radiated from outside into the accommodation chamber and a second part to lead a light produced by the illuminant material to the outside of the ink accommodation chamber, the ink accommodation chamber having a light collecting unit to collect the light produced by the illuminant material and increase its quantity;

a light emitting portion to project the radiated light into the first part, the radiated light introduced by the first part being radiated to the ink accommodated in the ink accommodation chamber to excite the illuminant material; and a light receiving portion facing the second part to receive the produced light led by the second part.

7. The printing apparatus according to claim 6, wherein the light emitting portion projects light of peak wavelength $\lambda 1$ having its band in an ultraviolet range or an infrared range, wherein the illuminant material receives the light of peak wavelength $\lambda 1$ and produces light of peak wavelength $\lambda 2$ having its band in an ultraviolet range or an infrared range different from the wavelength $\lambda 1$, wherein the light receiving portion receives the light of peak wavelength $\lambda 2$.

8. The printing apparatus according to claim 6, wherein the ink accommodation chamber of the ink tank has an optical prism, the optical prism passing the light radiated from outside in a situation in which ink exists in the ink accommodation chamber and reflecting the light radiated from outside in a situation in which no ink exists in the ink accommodation chamber, wherein the printing apparatus has a reflected light receiving portion to receive light reflected from the optical prism, wherein the light emitting portion projects light of peak wavelength $\lambda 1$ having its band in an ultraviolet range or an infrared range, wherein, in a situation in which no ink exists in the ink accommodation chamber, the illuminant material receives the light of peak wavelength $\lambda 1$ and produces light of peak wavelength $\lambda 2$ having its band in an ultraviolet range or an infrared range different from the wavelength $\lambda 1$, and the light receiving portion receives the light of peak wavelength $\lambda 2$, wherein, in a situation in which no ink exists in the ink accommodation chamber, the optical prism reflects the light of peak wavelength $\lambda 1$, and the reflected light receiving portion having a sensitivity of detecting light of peak wavelength $\lambda 1$ receives the light of peak wavelength $\lambda 1$.

* * * * *